US006161365A

United States Patent [19]

Girard et al.

[11] Patent Number: 6,161,365

[45] Date of Patent: Dec. 19, 2000

[54] METHOD FOR HERMETICALLY BAGGING MATERIAL, E.G. LUMBER PIECES, IN A TUBULAR PLASTIC TUBE

[75] Inventors: Yves Girard, Saints-Anges; Claude Labonté, St-Narcisse, both of Canada

[73] Assignee: Denis Comact Inc., St-Georges, Canada

[21] Appl. No.: 09/028,004

[22] Filed: Feb. 23, 1998

[30] Foreign Application Priority Data

Feb. 21, 1997 [CA] Canada ..... 2198201

[51] Int. Cl.[7] ..... B65B 53/00

[52] U.S. Cl. ..... 53/441; 53/459

[58] Field of Search ..... 53/567, 576, 577, 53/556, 441, 459, 370.6, 370.7, 370.4, 371.8, 481, 479, 450, 452, 457, 469, 476, 550, 568; 493/259, 255, 309

[56] References Cited

U.S. PATENT DOCUMENTS

| | | | |
|---|---|---|---|
| 3,902,303 | 9/1975 | King et al. | 53/184 |
| 3,983,682 | 10/1976 | Scully | 53/126 |
| 4,134,245 | 1/1979 | Stella | 53/547 |
| 4,872,309 | 10/1989 | Van Eijsden et al. | 53/441 |
| 5,125,218 | 6/1992 | Smith-Gander et al. | 53/576 |
| 5,398,487 | 3/1995 | Inman et al. | 53/567 |
| 5,400,569 | 3/1995 | Jones et al. | 53/433 |
| 5,421,144 | 6/1995 | Inman et al. | 53/567 |
| 5,425,221 | 6/1995 | Pronovost et al. | 53/567 |
| 5,524,420 | 6/1996 | Ikuta | 53/450 |
| 5,692,363 | 12/1997 | Inman et al. | 53/567 |
| 5,775,065 | 7/1998 | Tolson | 53/479 |
| 5,855,107 | 1/1999 | Haffield | 53/567 |
| 5,966,907 | 10/1999 | Julius | 53/450 |

FOREIGN PATENT DOCUMENTS

| | | | |
|---|---|---|---|
| 3908957 | 9/1990 | Germany | 53/567 |
| 4103384 | 8/1991 | Germany | 53/556 |

*Primary Examiner*—Ed Tolan
*Attorney, Agent, or Firm*—Jean H. Dubuc

[57] ABSTRACT

The bagging apparatus comprises a frame defining an opening for receiving bundles to be sheathed, bag retaining hook members mounted to the frame and displaceable between a retracted position for receiving an expandable sheath and an extended position where the sheath is stretched for allowing bundles to be introduced into the sheath through the upstream open ended portion thereof. Advancement mechanisms are provided for displacing the bundles through the bagging apparatus. A sealing unit located on a downstream side of the frame is operational for wrapping bundles into individual hermetic bags taken from the sheath. A loading arm may also be provided for installing the sheath onto the bag retaining hook members.

2 Claims, 11 Drawing Sheets

METHOD FOR HERMETICALLY BAGGING MATERIAL, E.G. LUMBER PIECES, IN A TUBULAR PLASTIC TUBE

BACKGROUND OF THE INVENTION

1. Field of the Invention

The present invention relates to a method for automatically sheathing goods, e.g. lumber, in plastic bags and, more particularly, in a plastic tube which is expanded for receiving the material and which is then sealed.

2. Description of the Prior Art

The forest industry is confronted with storage and exportation problems in that wood products, for instance lumber pieces, which result from milling operations and which are ready for commercial use must be stored in dry locations such as to preserve therein an appropriate degree of humidity (e.g. 6.0% to 8.0%) and must further be stored in dark settings such as to prevent the wood products from being exposed to ultraviolet rays (i.e. UV rays)

Bagging or sheathing apparatuses have been extensively used to bag agricultural products, for example hay bales, directly in the field or on the farm land and various such known apparatuses can be found in the prior art. Indeed, bagging devices are described, for instance, in U.S. Pat. No. 5,425,221 which issued to Pronovost et al. on Jun. 20, 1995 and in U.S. Pat. No. 5,398,487 and No. 5,421,144 which issued to Inmam et al. on Mar. 21, 1995 and on Jun. 6, 1995, respectively. These sheathing apparatuses provided extendable arms which are arranged to radially stretch a resilient cylindrical sheath, i.e. a plastic tube, such as to increase the transverse or cross sectional dimensions of the opening thereof thereby facilitating the insertion of hay bales within the tubular sheath. Once the material to be bagged is properly received in the sheath, the arms are retracted to allow the sheath to return under its inherent resiliency to a more contracted state and thus tightly envelop the bales.

More particularly, the above prior art apparatuses typically comprise the following basic elements: a rigid frame which is fixedly mounted on the chassis of a vehicle capable of displacement along the ground, a plurality of sheath retaining hook members which are mounted on the rigid frame and which are capable of outward and inward radial movements with respect to the rigid frame, and stretchable tubular bags. Each hook member is operated by its individual hydraulic ram. The tubular sheaths are normally disposed in a pleated, accordion-like, folded state and are gradually unfolded as material is received therein for bagging purposes. With the above apparatuses, the folded sheaths need to be manually positioned on the hook members. Also, the end pleat of the sheath must be pulled off the hook members to facilitate gathering and tying of sheath material to close the end of the sheath, i.e. of the formed bag. Therefore, the tubular sheath which is folded with accordion pleats around the hook members will gradually unfold during the loading of successive bales within the sheath so as to tighten around the loaded bales once the sheath is allowed to contract.

Basically, all of the above bale sheathing apparatuses are intended for sheathing agricultural products such as grass, hay, stalks and the like, into an elongated plastic bag having elastic characteristics and are thus not well adapted for bagging heavy rectangular loads, such as bundles of lumber strips, planks, boards, etc.

SUMMARY OF THE INVENTION

It is therefore an aim of the present invention to provide a method to load material, for instance bulk material including bundles of lumber, into flexible plastic tubular bags.

It is also an aim of the present invention to provide such a method in which the individual bags are taken from a stretchable tubular plastic sheath which is made of a material capable of protecting the bags' contents from ultraviolet rays, even under considerable, if not severe, sunlight exposure and which is, once filled at an entry end thereof with material, sealed and separated from the yet unused portion of the tubular sheath, whereby the bagged material, e.g. lumber, is protected against deterioration under the effects of light and humidity.

It is still a further aim of the present invention to provide such a method in which a stretchable tubular plastic sheath is closed at a first end thereof and stretched in a desired configuration typically dependent of the shape of the material to be bagged and, as the material is being loaded therein, is released to tightly envelop the material and, once the material has been completely loaded therein, is sealed and separated from the yet unused portion of the tubular sheath.

Further in accordance with the present invention, there is provided a method of wrapping bundles into individual bags, comprising the steps of installing a folded tubular expandable resilient sheath around a plurality of displaceable bag retaining means, stretching the sheath so as to define a taut upstream receiving opening for allowing insertion of bundles into the sheath, closing a downstream end portion of the sheath, completely inserting a bundle into the sheath, making a cut in the sheath upstream of a rear end of the bundle to separate the sheath in two distinct parts, closing the sheath on each side of the cut so as to form a closed end adjacent the rear end of the bundle and a new closed downstream end for a next bundle to be bagged.

Further in accordance with the present invention, there is provided a method comprising the steps of advancing a first bundle through the sheath such that as a front end thereof engages the closed downstream end portion of the sheath, the sheath gradually unfolds from said bag retaining means and contracts around the first bundle, advancing a second bundle through the taut receiving opening and into the sheath, immobilizing the first and second bundles into an appropriate position where a rear end of the first bundle is located downstream from a sealing unit and a front end of the second bundle is located upstream from the sealing unit, moving the first bundle back to an appropriate position where the rear end thereof is still downstream from the sealing unit, activating the sealing unit to cut and seal the sheath on each side of the cut.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
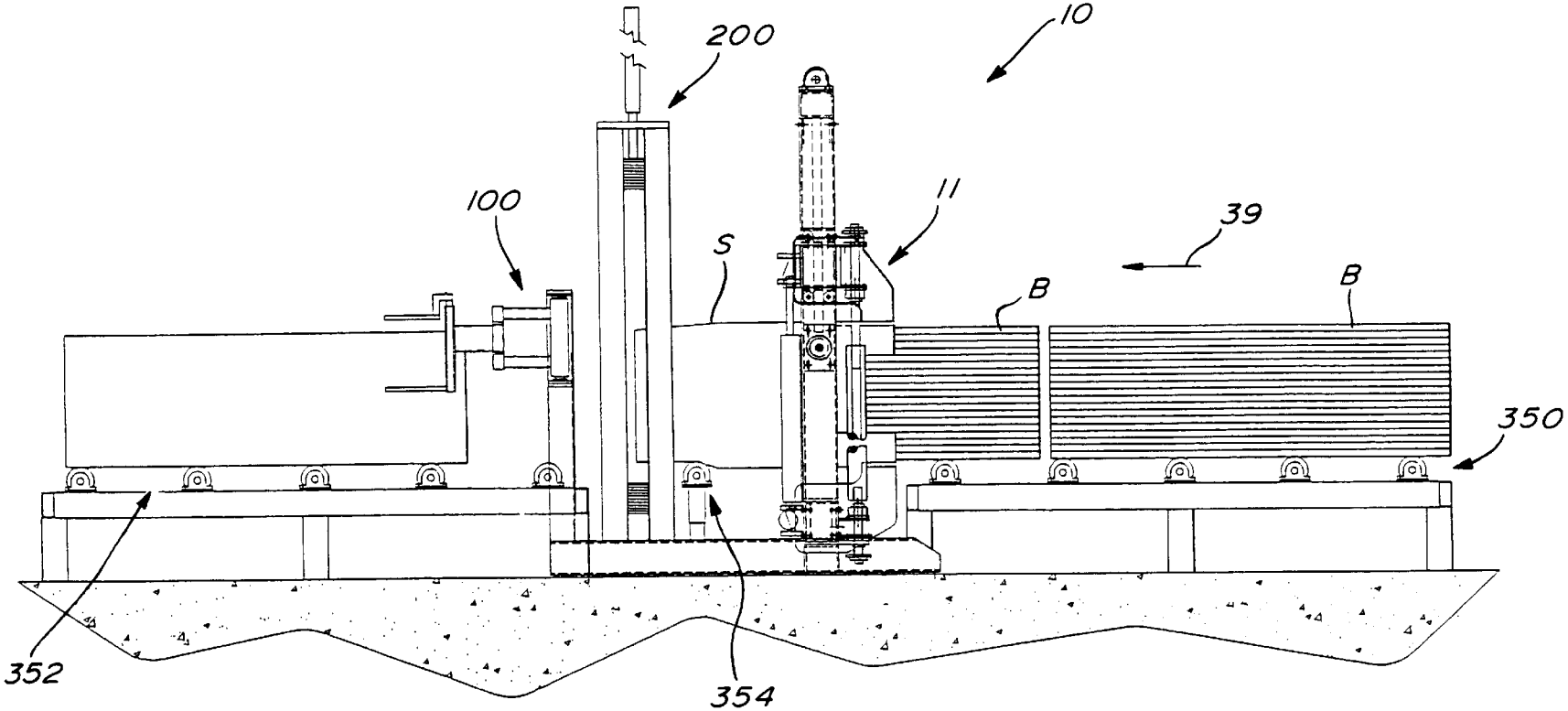
FIG. 1 is a schematic side elevational view of a sheathing apparatus comprised of a stretching unit, a sealing unit, a loading arm and entry and exit conveyors in accordance with the present invention.

Now referring to the drawings, and in particular to FIG. 1, a sheathing apparatus in accordance with the present invention and generally designated by numeral 10 will be described.

The sheathing apparatus 10, as will be explained hereinafter, is adapted to sheath or bag a square or rectangular bundle of wood B within a resilient sheath S. The sheath S takes the form of an elongated tube made of a flexible, stretchable, resilient plastics material which is typically packaged in a accordion-like folded fashion such as to define an inner opening therethrough. One such plastic tube is of sufficient length such that it is used to wrap a number of wood bundles (or other material to be bagged) in individual hermetic bags with the tube being typically cut before each bundle has been sealed.

Basically, the folded tube is supported through its opening by hooks which are adapted to stretch the folded tube such that material can be displaceably loaded therein. Typically, the tube is sealed at a downstream end thereof and, once the material has been conveyed into the folded tube's opening and has abutted the sealed downstream end thereof, the continued advancement of the material through the tube causes the gradual deployment thereof (i.e. the downstream end of the tube unfolds) and the material is thus gradually covered by the downstream end of the stretched tube. Once off the hooks, the tube contracts due to its resiliency, towards its at rest position thereby tightly or snugly covering the material. The tube is then sealed upstream of the bagged material and cut thereat in such a way that the remainder of the tube is sealed at its new downstream end and can now thus receive a new load which will be bagged as per the cycle described hereinbefore.

The sheath S or tube is provided with a white exterior to reflect the sunlight and thus reduce internal temperatures and with a black interior to improve opacity. The sheath S also offers a protection against UV rays. Furthermore, the sealing of both ends of the bag, i.e. on the upstream and downstream sides or ends of the bagged material, will be made hermetic, at least in the case of bagged wood products, such as to retain the wood's humidity which is especially important when the bagged wood products are exported and are thus not used for a more considerable period of time.

If we now refer more specifically to the drawings, the sheathing apparatus 10 generally comprises a stretching unit 11, a loading arm 100 and a sealing unit 200.

Figure 2:
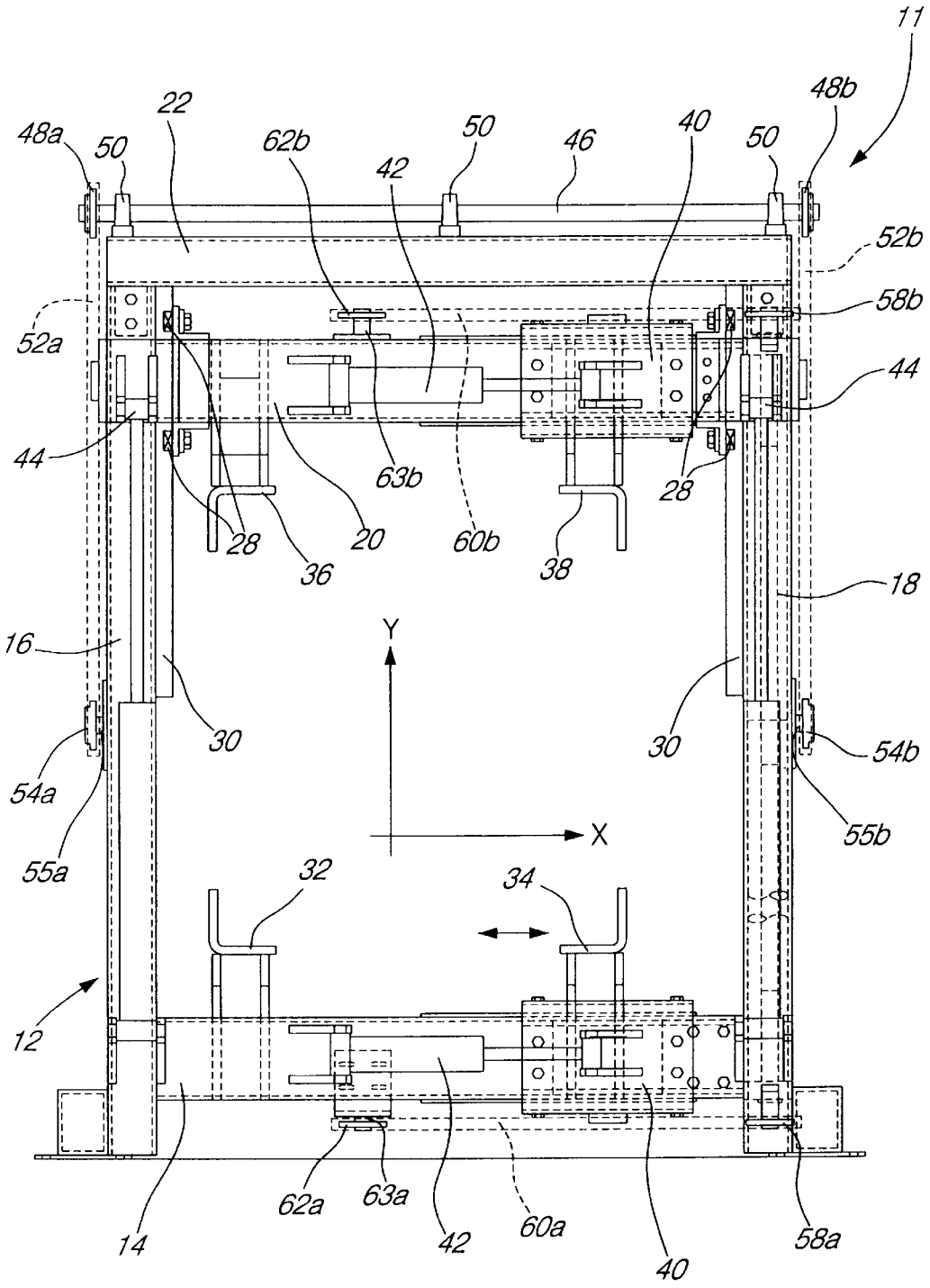
FIG. 2 is a rear end elevational view of the stretching unit, wherein bag retaining hook members thereof are illustrated in their extended positions.

As shown in FIG. 2, the stretching unit 11 includes a frame 12 which is expandable by way of a sliding side mechanism so that the frame 12, as will later be explained, can be configured to define different sizes of openings so as to be able to accommodate various sizes of bundles for the sheathing thereof. The frame 12 comprises a horizontal bottom member 14, two vertical side members 16 and 18 secured to opposite ends of the bottom member 14, an upper mobile member 20 slidably mounted to the vertical side members 16 and 18 and a head member 22 fixedly mounted to the upper ends of the vertical side members 16 and 18. Therefore, the frame 12 defines a rectangular configuration along a vertical plane. The bottom member 14, the vertical side members 16 and 18, the upper mobile member 20 and the head member 22 are all made of solid square tubing.

Figure 4:
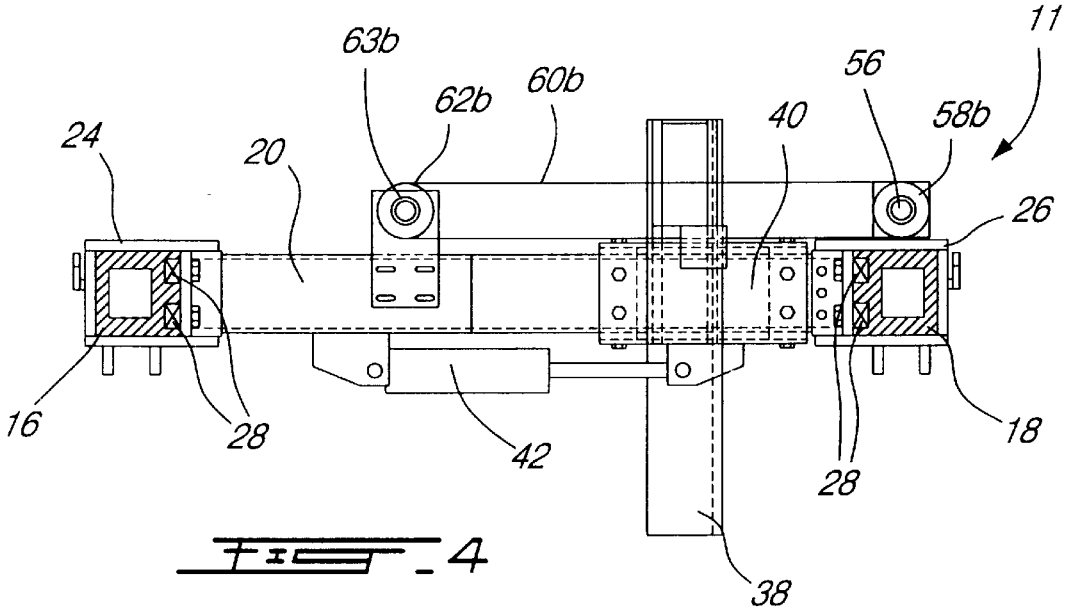
FIG. 4 is a top plan view of the stretching unit of FIG. 2 as seen from below a head member thereof and illustrating an upper mobile member thereof slidably mounted at its opposed ends to two vertical side members.

The upper mobile member 20 is provided at opposite ends thereof with square tubular connection members 24 and 26 defining inside openings adapted to receive the vertical side members 16 and 18, respectively, as best seen in FIG. 4. Four rollers 28 are mounted at the two ends of the upper mobile member 20 within the tubular connection members 24 and 26 for engagement with guide ribs 30 extending longitudinally along the inner sides of both vertical side members 16 and 18. Therefore, the upper mobile member 20 of the frame 12 is vertically slidable along the vertical side members 16 and 18.

Figure 3:
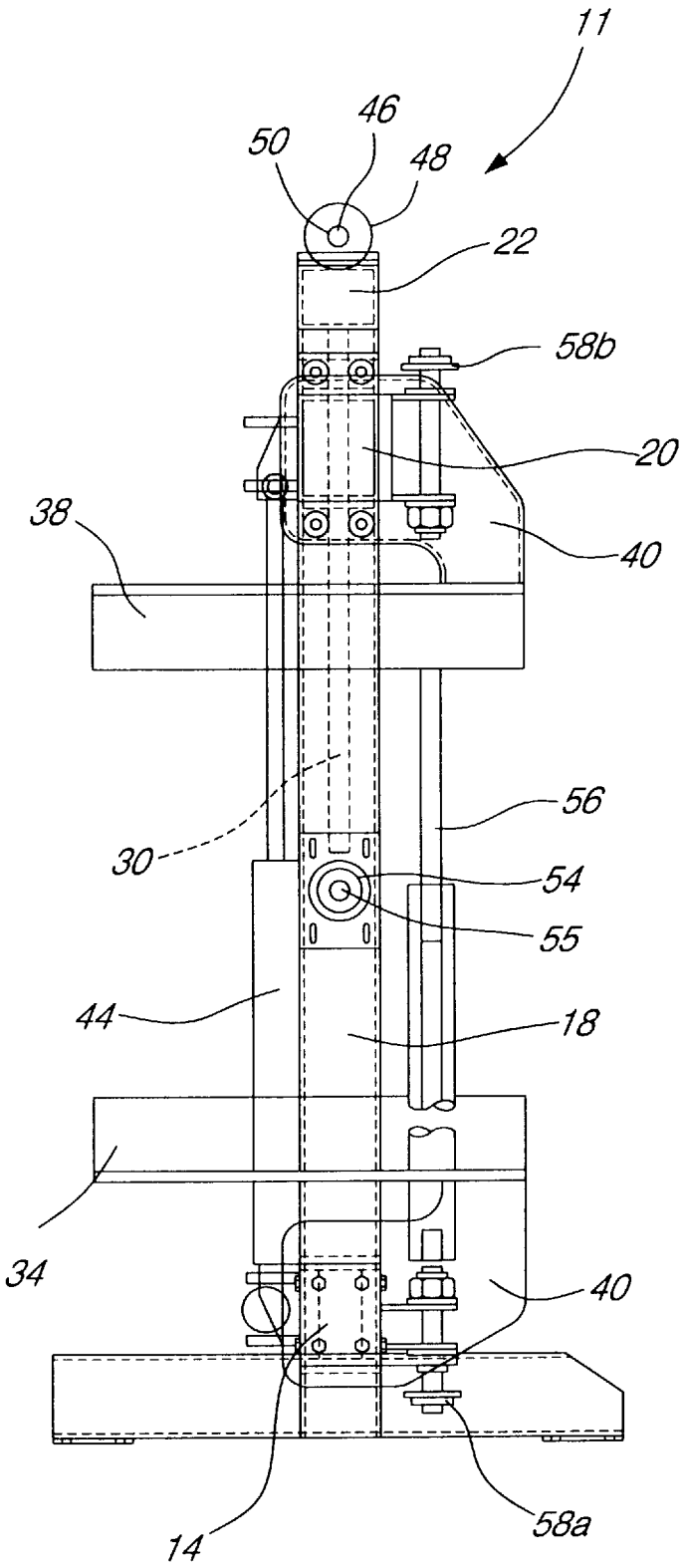
FIG. 3 is a side elevational view of the stretching unit of FIG. 2.
Figure 5:
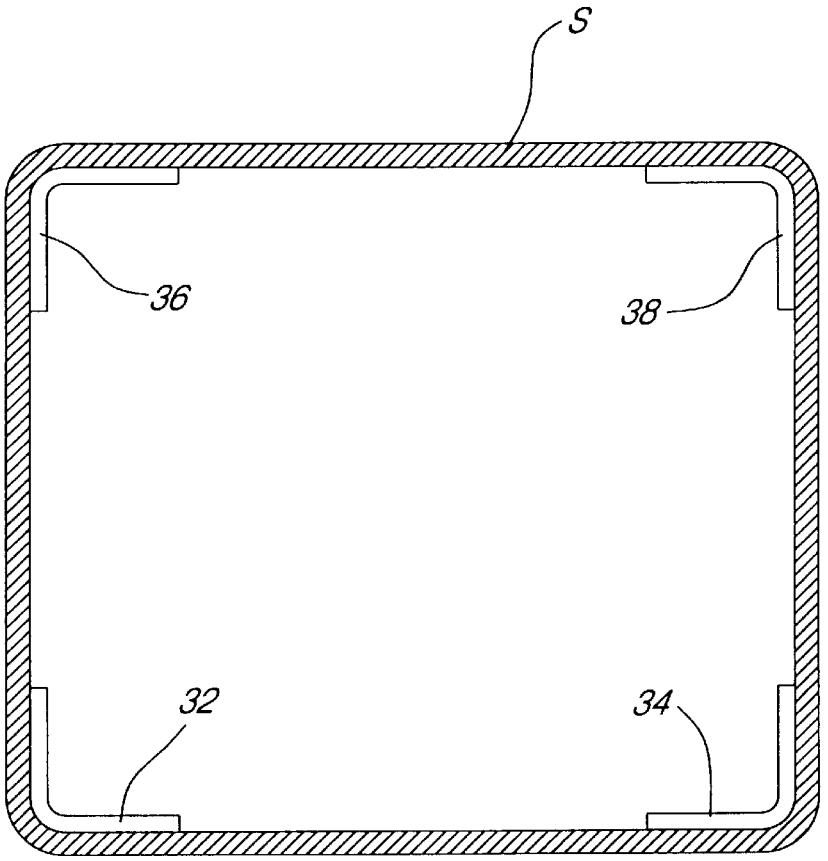
FIG. 5 is a schematic end elevational view of the retaining hook members of the stretching unit of FIG. 2 with a resilient tubular folded sheath disposed thereon.

As clearly shown in FIGS. 2, 3 and 5 the stretching unit 11 includes four retaining hook members 32, 34, 36 and 38 which are mounted on the frame 12 and which are adapted to receive a sheath S folded in accordion like manner with several pleats. Each hook member 32, 34, 36 and 38 is L-shaped and extends parallel to the loading direction represented by arrow 39 in FIG. 1 toward the rear or downstream side of the stretching unit 11.

In the illustrated embodiment, retaining hook members 32 and 36 are respectively fixedly mounted to the bottom member 14 and to the upper mobile member 20 while retaining hook members 34 and 38 are slidably mounted on the bottom member 14 and on the upper mobile member 20, respectively.

The retaining hook members 34 and 38 are secured to a horizontal tubular slidable sleeve 40 having a square opening sized to slidably receive the horizontal members of the frame 12, namely the bottom member 14 and the upper mobile member 20.

The tubular slidable sleeves 40 and the upper mobile member 20 of the frame 12 are slidably movable respectively by operation of horizontal cylinders 42 and vertical cylinders 44. Therefore, retaining hook member 34 is laterally movable on the bottom side member 14 by operation of the horizontal cylinder 42 provided at the bottom of the frame 12, retaining hook members 36 and 38 which are mounted to the upper mobile member 20 of the frame 12 are vertically movable by operation of both vertical cylinders 44, and retaining hook member 38 is also laterally movable by operation of the horizontal cylinder 42 mounted to the upper mobile member 20. Hence, the retaining hook member 32, which is secured to the bottom member 14 of the frame 12, is the only hook member which is herein not displaceable.

The vertical cylinders 44 are operated simultaneously and the same holds true for both horizontal cylinders 42. A control system including an automaton or the like, not shown in the drawings, is provided to control the operation of the cylinders 42 and 44 in accordance with the size of the sheath S and thus with the size of bundle B to be sheathed. Therefore, the frame 12 is adapted to define different square or rectangular receiving openings through which different sizes of material can be fed.

Moreover, the cylinders 42 and 44 can be paired by connection to each other to ensure that the sheath S is stretched uniformly around its periphery. As shown in FIG. 2, a shaft 46 provided at a first end thereof with a sprocket 48*a* and at a second end thereof with a sprocket 48*b* is supported by three pillow blocks 50 which are secured to the head member 22 of the frame 12. A chain 52*a* is engaged with the sprocket 48*a* and with an idle sprocket 54*a* which is mounted on a pin 55*a* extending perpendicularly outwardly from the vertical side member 16. Similarly, a chain 52*b* is engaged with the sprocket 48*b* and with an idle sprocket 54*b* which is mounted on a pin 55*b* extending perpendicularly outwardly from the vertical side member 18. Both chains 52*a* and 52*b* are driven by the upper mobile member 20 of the frame 12. Therefore, the vertical displacement of the upper mobile member 20 causes the displacement of the chains 52*a* and 52*b* and thus the rotation of the shaft 46 which thus ensures a substantially equal distribution of the total force required to move the upper mobile member 20. The stretchable sheath S retained by the hook members 32 to 38 is thus stretched uniformly around its periphery.

As best seen in FIG. 3, a telescopic shaft 56, which is mounted at the upper end thereof to the tubular connection member 26 and at a lower end thereof to the bottom member 14 of the frame 12, is respectively provided at its ends with sprockets 58*a* and 58*b*. The telescopic shaft 56 is adapted to collapse or extend with the vertical cylinders 44 so as to allow for and guide the displacements of the upper mobile member 20.

A chain 60*a* is engaged with sprocket 58*a* and with an idle sprocket 62*a* which is mounted on a pin 63*a* extending perpendicularly outwardly from the bottom member 14. Similarly, a chain 60*b* is engaged with sprocket 58*b* and with an idle sprocket 62*b* which is mounted on a pin 63*b* extending perpendicularly outwardly from the upper mobile member 20. Both chains 60*a* and 60*b* are driven by the horizontal sliding sleeves 40. Therefore, the lateral displacement of both square tubular sliding sleeves 40 along the horizontal members 14 and 20 of the frame 12 causes the displacement of the chains 60*a* and 60*b* and thus the rotation of the sprockets 58*a* and 58*b* and of the telescopic shaft 56 such that the force needed to horizontally stretch the sheath S is uniformly distributed on the two horizontal cylinders 42.

Figure 6:
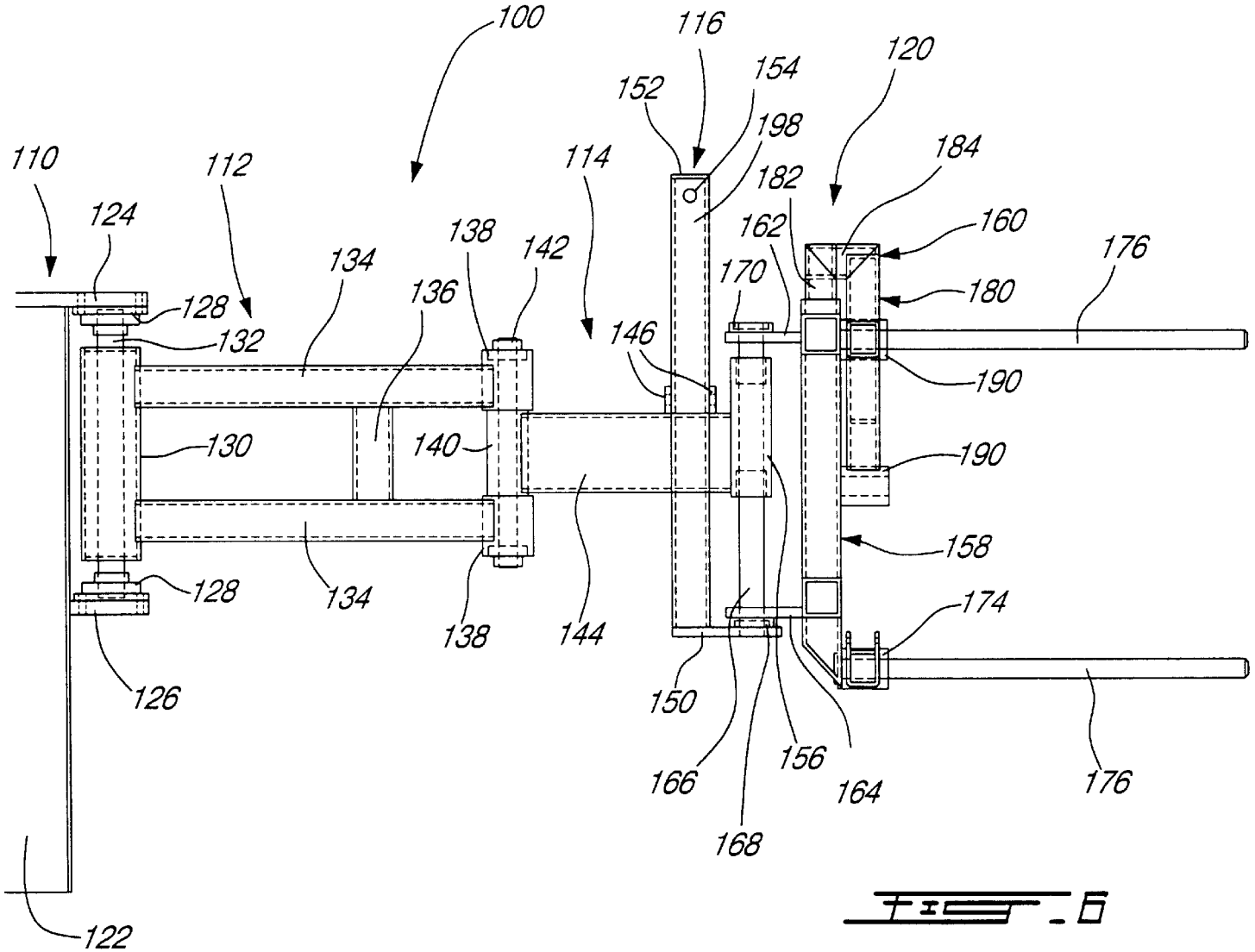
FIG. 6 is side elevational view of the loading arm of the sheathing apparatus of FIG. 1.

The loading arm 100 illustrated in FIG. 6 saves time and to reduces the number of operators required for loading the sheath S on the stretching unit 11. More specifically, the loading arm 100 comprises a vertical support member 110, a first arm portion 112 pivotally mounted to the vertical support member 110, a second arm portion 114 pivotally mounted to the first arm portion 112, a vertically displaceable member 116 connected to the second arm portion 114 with a cylinder (not shown) to vary the elevation of member 116 with respect to the second arm portion 114, and a third arm portion 120 pivotally mounted to the vertical displaceable member 116.

The vertical support member 110 is disposed downstream from the sealing machine 200 at a side thereof and includes a vertical member 122 secured at a bottom end thereof to a base structure, a first horizontal supporting plate 124 secured to the upper end of the vertical member 122 and a second horizontal supporting plate 126 secured to a middle portion of the vertical member 122. Two flange bearings 128 are respectively secured to the underside of the first horizontal supporting plate 124 and to the top surface of the second horizontal supporting plate 126.

The first arm portion 112 is provided at a first end thereof with a cylindrical member 130 which defines a longitudinal bore extending centrally therethrough for receiving a shaft 132 having a length dimension exceeding that of the cylindrical member 130. The shaft 132 is welded to the cylindrical member 130 and is mounted at each end thereof to the flange bearings 128 so that the first arm portion 112 may be manually rotated about a vertical axis extending centrally through the shaft 132. The first arm portion 112 further includes two identical horizontal members 134 protruding in parallel relationship from the cylindrical member 130. A reinforcing member 136 extends at right angles between the two horizontal members 134 for increasing the rigidity of the first arm portion 112. Each horizontal member 134 is provided at a second end thereof with a cylindrical member 138 which defines a seat for receiving a bearing.

The second arm portion 114 is provided at a first end thereof with a cylindrical member 140 which is dimensioned to fit between the two cylindrical members 138 disposed at the second end of the first arm portion 112. The cylindrical members 138 and 140 each defines a central longitudinal bore for allowing the passage therethrough of a shaft 142. Once the shaft 142 has been inserted into the cylindrical members 138 and 140, the same may be secured in position by any suitable means such as taper pins, split pins or the like. Accordingly, the second arm section 114 may be manually rotated about a vertical axis extending centrally through the shaft 142. The second arm portion 114 further includes a horizontal member 144 extending from the cylindrical member 140 and having on an upper surface thereof a pair of eyelets 146 for enabling the aforementioned cylinder to be attached thereto. The aforementioned cylinder is attached at an opposed end thereof to the vertical displaceable member 116 and thus it is operational for vertically displacing the vertical displaceable member 116 relative to the second arm portion 114. The vertical displaceable member 116 comprises two spaced-apart C-shaped elongated members 148 which are secured at a bottom end thereof to a supporting plate 150 and connected to each other at upper ends thereof by a horizontal reinforcing plate 152. Each C-shaped elongated member 148 defines a hole 154 at an upper end thereof for receiving therein a pin for connecting the aforementioned cylinder (not shown) to the vertical displaceable member 116. The horizontal member 144 of the second arm portion 114 extends between the two spaced-apart C-shaped elongated members 148 of the vertical displaceable member 116, thereby allowing for movement of member 116 relative to the second arm portion 114.

A cylindrical member 156 is welded to a second end of the horizontal member 144 of the second arm portion 114 and defines at each end thereof an enlarged bore section for receiving therein a bushing. Each enlarged bore section communicates with a central longitudinal bore which extends through the cylindrical member 156.

The third arm portion 120 of the loading arm 100 comprises a bottom part 158 and an upper part 160. The bottom part 158 is provided with two spaced-apart connecting plates 162 and 164 which protrude at right angles from the back of the bottom part 158. The connecting plate 162 defines a hole for allowing the passage therethrough of a shaft 166. The connecting plate 164 is provided on an underside thereof with protuberance 168 which has a recess for receiving a thrust bearing. A bore is defined in the connecting plate 164 and in the center of the protuberance 168 for receiving the bottom end portion of the shaft 166.

Accordingly, the bottom part 158 of the third arm portion 120 is coupled to the vertical displaceable member 116 and to the second arm portion 114 by inserting the shaft 166 through the connecting plate 162, the cylindrical member 156 and the connecting plate 164. The supporting plate 150 of the vertical displaceable member 116 defines a hole through which is received a threaded rod or the like which is threadably engaged to the shaft 166. The shaft 166 is provided at an opposed end thereof with a head portion 170 to restrict the axial movement thereof. Once the shaft 166 has been secured in position, the third arm portion 120 may be manually rotated about a vertical axis extending centrally through the shaft 166 and may be vertically displaced with the vertical displaceable member 116 by operation of the aforementioned cylinder.

Figure 7:
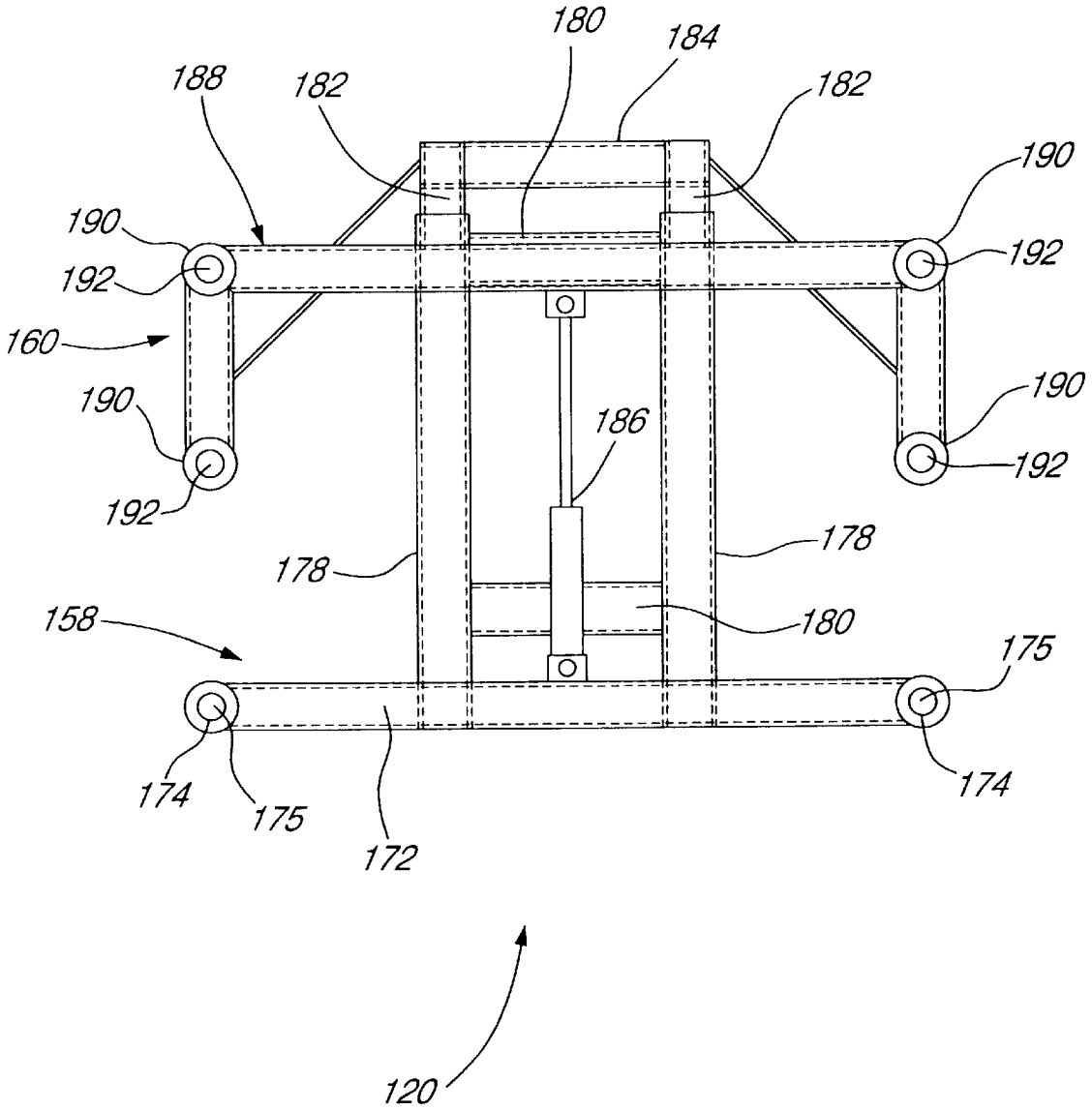
FIG. 7 is a front end elevational view of a third arm portion of the loading arm of FIG. 6.

As shown in FIG. 7, the bottom part 158 of the third arm portion 120 further includes a horizontal bottom member 172 which is provided at each end thereof with a cylindrical member 174. Each cylindrical member 174 defines a longitudinal bore 175 extending transversally relative to the horizontal bottom member 172 in a horizontal plane for removably receiving therein an elongated loading finger 176. Two spaced-apart vertical tubular members 178 are welded at a bottom end portion thereof to a rear surface of the bottom member 172. The above-described connecting plates 162 and 164 are respectively secured to two horizontal reinforcing members 180 extending between the two vertical tubular members 178.

The upper part 160 of the third arm portion 120 includes two spaced-apart vertical members 182 which are secured at an upper end portion thereof to a rear portion of a top member 184. The vertical members 182 are dimensioned and disposed to be slidably received into the vertical tubular members 178 of the bottom part 158. A cylinder 186 is provided for vertically displacing the upper part 160 relative to the bottom part 158. A front structure 188 extends downwardly from a front portion of the top member 184 for supporting a pair of elongated loading fingers 176. More particularly, the front structure 188 includes two pairs of cylindrical members 190 which are disposed at different elevations. Each cylindrical member 190 defines a longitudinal bore 192 for receiving therein an elongated loading finger 176. Accordingly, depending on the size of the tubular sheath S and thus of the size of the material to be bagged, the elongated loading fingers 176 will be removably inserted into the bottom pair 174 and into the upper or lower pairs of the cylindrical members 190 for receiving thereon the tubular sheath S. Once the tubular sheath S has been positioned around the elongated loading fingers 176, the cylinder 186 may be extended so as to move the upper part 160 of the third arm portion 120 upwardly and thus vertically stretch the sheath S.

The elongated loading fingers 176 may each be provided with a head portion to restrict the axial displacement thereof within the cylindrical members 174 and 190.

It is pointed out that all the members of the loading arm 100 are made of rigid material such as steel.

Figure 8:
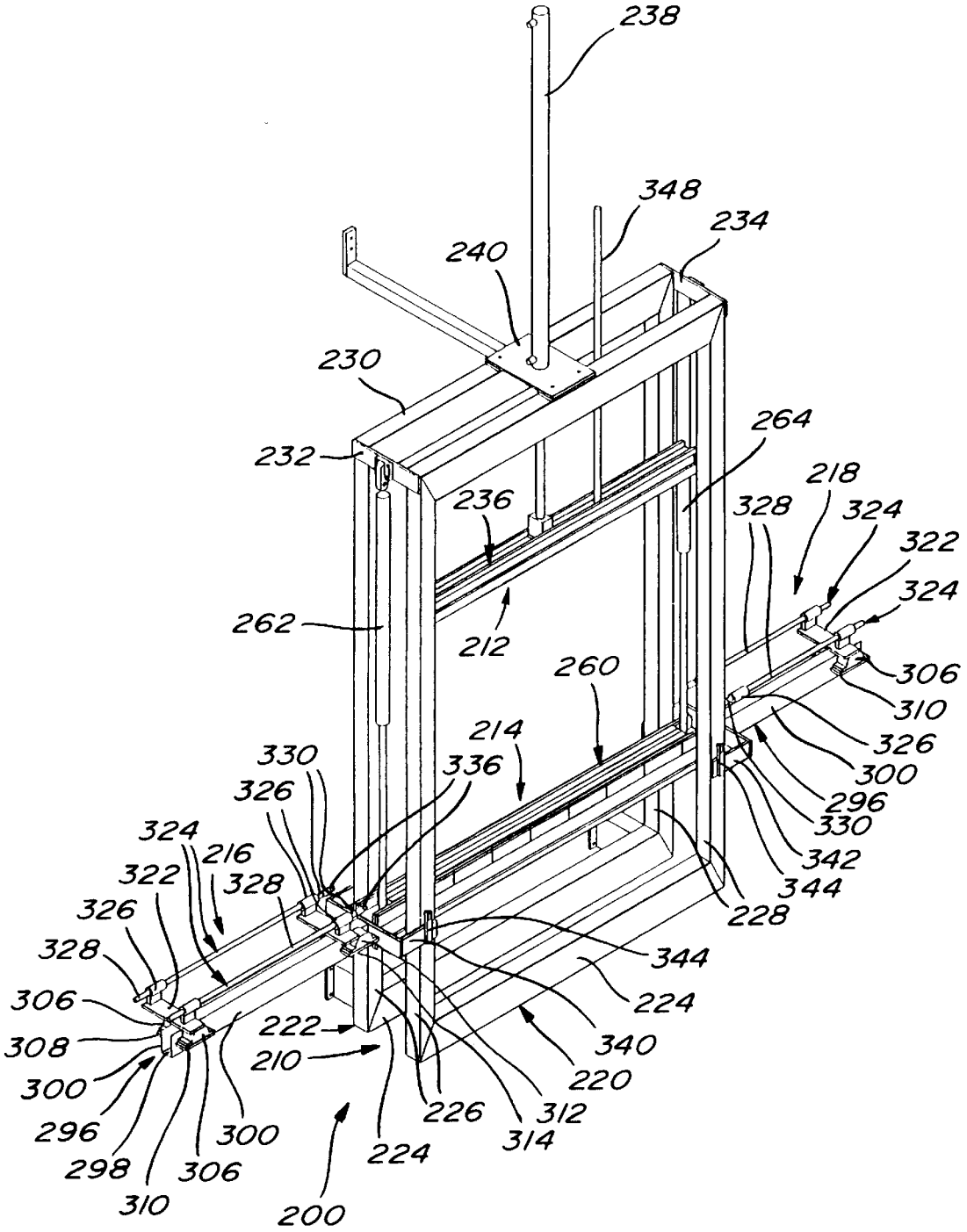
FIG. 8 is a simplified perspective view of the sealing unit of the sheathing apparatus of FIG. 1.

As illustrated in FIG. 8, the sealing unit comprises a frame 210, upper and bottom jaw assemblies 212 and 214 which are mounted to the frame 210 and which are capable of vertical movement with respect to the frame 210, and two bag folding finger assemblies 216 and 218 which are respectively mounted to opposed ends of the bottom jaw assembly 214 so that they generally face each other from opposite sides of the frame 210.

The frame 210 includes a rear frame structure 220 and a front frame structure 222 which are positioned in parallel relation to each other. The rear and front frame structures 220 and 222 each include a horizontal bottom member 224, two vertical side members 226 and 228 respectively secured to the opposite ends of the bottom member 224, and a horizontal top member 230 mounted at a first end thereof to the upper end of the vertical side member 226 and at a second end thereof to the upper end of the vertical side member 228.

A transversal connecting plate 232 is secured at opposite ends thereof to the upper ends of the vertical side members 226 for connecting the rear frame structure 220 to the front frame structure 222. Similarly, a transversal connecting plate 234 is secured at opposite ends thereof to the upper ends of the vertical side members 228.

The upper jaw assembly 212 includes an upper jaw member 236 connected to a cylinder 238 which is in turn mounted to a transversal supporting plate 240 secured to the horizontal top members 230 of the rear and front frame structures 220 and 222. The cylinder 238 is operational to upwardly or downwardly displace the upper jaw member 236 relative to the frame 210.

Figure 9:
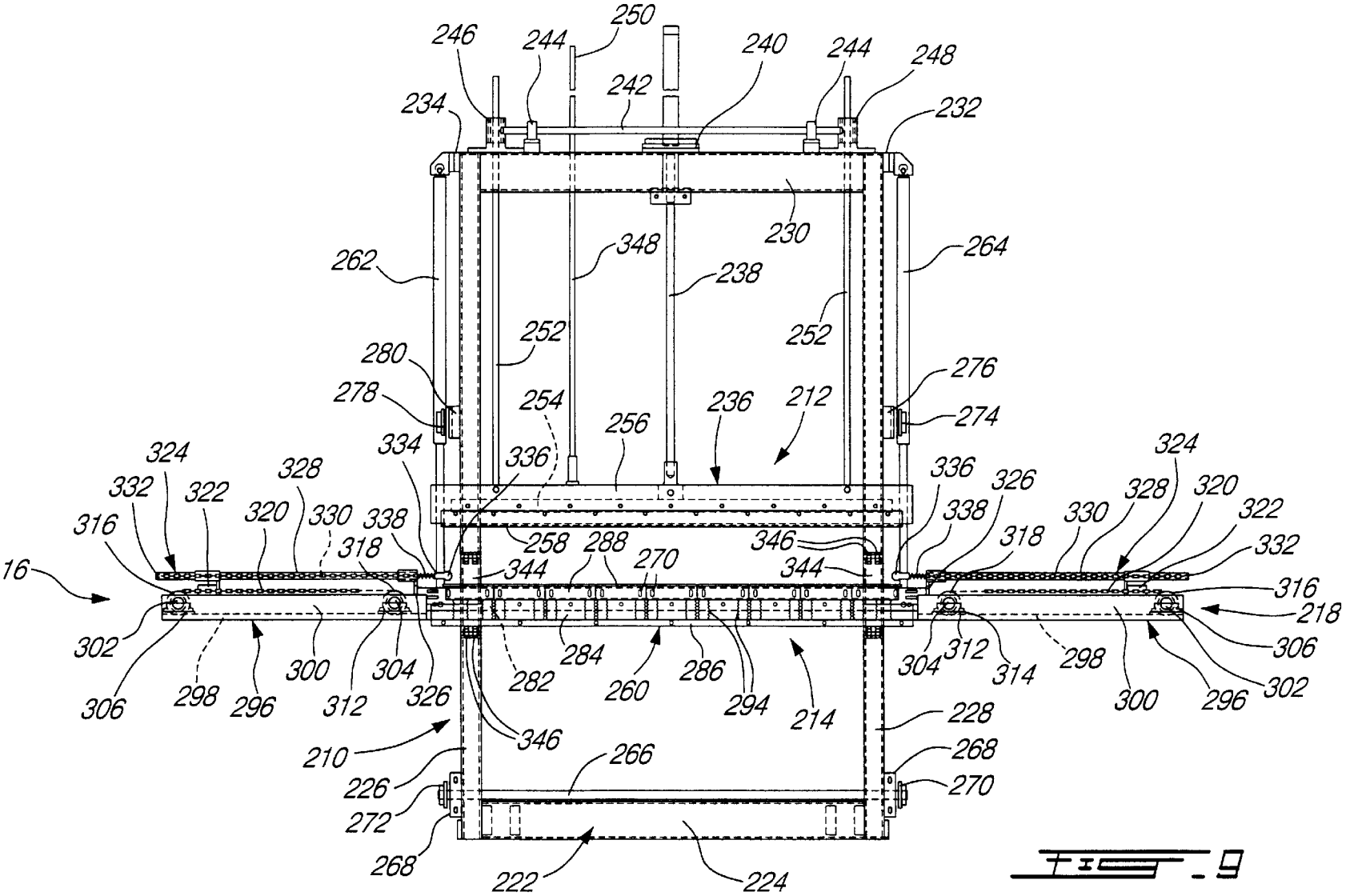
FIG. 9 is front elevational view of the sealing unit.

As shown in FIG. 9, the upper jaw assembly 212 further includes a shaft 242 supported by two pillow blocks 244 which are secured to the horizontal top member 230 of the rear frame structure 220. The shaft 242 is provided at a first end thereof with a first sprocket 246 and at a second end thereof with a second sprocket 248. Two racks 250 and 252 are secured at a bottom end thereof to the upper jaw member 236 and mesh with pinions 246 and 248, respectively. Accordingly, the movement of the racks 250 and 252 with the upper jaw member 236 causes the shaft 242 to rotate, thereby ensuring that the upper jaw member 236 is level while being vertically displaced by the cylinder 238.

The upper jaw member 236 includes a longitudinal core element 254, two lateral members 256 respectively secured to the sides of the longitudinal core element 254, and two bag holding members 258 respectively secured to the lateral members 256 and extending downwardly towards the bottom jaw assembly 214.

The bottom jaw assembly 214 includes a bottom jaw member 260 connected at a first end thereof to a first cylinder 262 and at a second end thereof to a second cylinder 264. The first and second cylinders 262 and 264 are respectively connected at respective upper ends thereof to the transversal connecting plates 232 and 234.

As shown in FIG. 9, a shaft 266 is supported by two pillow blocks 268 which are respectively secured to a bottom portion of vertical side members 226 and 228 of the rear frame structure 220. The shaft 266 is provided at a first end thereof with a first sprocket 270 and at a second end thereof with a second sprocket 272. A chain (not shown) engages the first sprocket 270 and an idle sprocket 274 supported by a support member 276 mounted to a middle portion of the vertical side member 228 of the rear frame structure 220. Similarly, a chain (not shown) engages the second sprocket 272 and an idle sprocket 278 supported by a support member 280 mounted to a middle portion of the vertical side member 226 of the rear frame structure 220. Both these chains (not shown) are driven by the bottom jaw member 260. Accordingly, the vertical displacement of the bottom jaw member 260 causes the displacement of the chains (not shown) and thus the rotation of the shaft 266 which thus ensures a substantially equal distribution of the total force required to move the bottom jaw member 260, whereby the latter is level when being upwardly or downwardly displaced by the cylinders 262 and 264.

The bottom jaw member 260 includes an elongated core element 282 extending transversally relative to the sealing apparatus 200, two lateral members 284 secured to respective opposite sides of the elongated core element 282, two longitudinal support members 286 laterally secured to respective lateral members 284 at bottom portions thereof, and two series of bag holding members 288 laterally mounted to respective upper portions of the lateral members 284. Each series of bag holding members 288 extends longitudinally along a side of one of the lateral members 284. Each bag holding member 288 defines at each end thereof a vertical slot 290 for a fastener (not shown) to pass therethrough for connecting the bag holding member 288 to one of the lateral members 284, while at the same time allowing the bag holding member 288 to move downwardly or upwardly relative to the lateral member 284 associated therewith. Each bag holding member 288 is supported at each end thereof by a pair of springs 294 which are secured at a bottom end thereof to one of the longitudinal support member 286 and at an upper end thereof to an underside of the bag holding member 288. The springs 294 permit to properly hold the sheath S while the same is being cut and sealed.

The upper jaw member 236 and the bottom jaw member 260 are each provided between the lateral members 256 and 284 thereof with two parallel longitudinal heating bands (not shown) which are operational for simultaneously sealing the sheath S at two separate locations. A heating filament (not shown) extends between the two longitudinal heating bands of the bottom jaw member 260 for transversally cutting the sheath S with respect to a longitudinal axis thereof. It is noted that the heating filament could be mounted to the upper jaw member 236 instead of the bottom jaw member 260. A power source (not shown) is connected to the heating bands and the heating filament for powering the same.

The bag holding members 258 of the upper jaw member 236 and the bag holding members 288 of the bottom jaw member 260 are adapted to cooperate to hold the sheath S while the same is being cut and sealed on each side of the cut. More particularly, when the upper and bottom jaw members 236 and 260 are displaced towards each other to a position where the bag holding members 258 of the upper jaw member 236 push on the bag holding members 288 of the bottom jaw member 260 against the biasing forces of the springs 294, the sheath S is retained in position by the compression forces exerted thereon by the bag holding members 258 and 288 of the upper and bottom jaw members 236 and 260.

As shown in FIGS. 8 and 9, the folding finger assemblies 216 and 218 are each provided with a carrier 296 which is secured to one end portion of the bottom jaw member 260. The carrier 296 includes a bottom wall 298 and a pair of side walls 300. The side walls 300 define at a first end portion thereof a first pair of aligned holes and at a second end portion thereof a second pair of aligned holes for respectively receiving first and second shafts 302 and 304. The first shaft 302 is supported by a first pair of pillow blocks 306 which are respectively mounted to a first supporting plate 308 extending outwardly from one side wall 300 and to a second supporting plate 310 extending outwardly from the other side wall 300. Similarly, each second shaft 304 is supported by a second pair of pillow blocks 312 which are each mounted to a third supporting plate 314 extending outwardly from one side wall 300 and to a fourth supporting plate (not shown) extending outwardly from the other side wall 300. As shown in FIG. 9, a first and second sprockets 316 and 318 are respectively mounted on the first and second shafts 302 and 304 between the side walls 300 of the carrier 296 for engaging a chain 320. The chain 320 meshes with a supporting member 322 to which a pair of parallel fingers 324 are fixedly mounted. Each finger 324 is slidably received at opposed ends thereof in guides 326 secured to the second end portion of the carrier 296. Therefore, the first shaft 302 or the second shaft 304 may be rotated by a motor (not shown) to drive the chain 320 and thus inwardly or outwardly displace the support member 322 and the fingers 324 relative to the frame 210 of the sealing unit 200.

Each finger 324 includes a tubular member 328 adapted to slidably receive a rod 330 having a first end 332 and a second end 334. The rod 330 is provided at the second end 334 thereof with a head member 336. A spring 338 is mounted on the rod 330 between the head member 336 and an inlet end of the tubular member 328 to normally urge the head member 336 away from the tubular member 328. A limit switch (not shown) is provided in the tubular member 328 opposite the inlet end thereof to be engaged by the first end 332 of the rod 330 when the rod 330 is pushed into the tubular member 328 against the spring force acting on the head member 336. The limit switch (not shown) is operational to cut off power automatically when engaged by the first end 332 of the rod 330 to stop the displacement of the fingers 324 towards the center of the sealing unit 200.

In operation, the fingers 324 are displaced towards the center of the sealing unit 200 on each side of the upper and bottom jaw members 236 and 260 to thus pleat the sheath S on each side of the heating filament (not shown) for the subsequent sealing operation. As the fingers 324 are displaced towards the center of the sealing unit 200, the pressure exerted thereon increases up to a point where this pressure exceeds the spring forces acting on the head members 336. When such a pressure is reached, the springs 338 are compressed and the rods 330 are pushed into the tubular members 328, thereby causing the first ends 332 of the rods 330 to engage the limit switches (not shown), thereby immobilizing the fingers 324. It is pointed out that depending on the height of the bundle to be bagged, the tension in sheath S varies and thus the displacement of the fingers 324 is different.

As seen in FIGS. 8 and 9, a first C-shaped member 340 extends from the bag folding finger assembly 216 for receiving therebetween the vertical side walls 226 of the front and rear frame structures 222 and 224. A second C-shaped member 342 extends from the bag folding finger assembly 218 for receiving therebetween the vertical side walls 228 of the front and rear frame structures 222 and 224. The first and second C-shaped members 340 and 342 are provided at each end thereof with a guide 344. Each guide 344 is provided at each end thereof with a pair of rollers 346 mounted for rotation about an axis which is perpendicular to the vertical side members 226 and 228 and in the plane of the frame 210. Therefore, when the cylinders 262 and 264 are activated to vertically displace the bottom jaw member 260 and the bag folding finger assemblies 216 and 218 secured thereto, the rollers 346 roll along the vertical side walls 226 and 228 to guide the movement of the bottom jaw member 260.

An elongated member 348 extends upwardly from a top surface of the upper jaw member 236 to engage a pulley (not shown) which may be mounted on the top of the frame 210 and connected to a control system (not shown) adapted to control the operation of the sealing unit 200. Other sensors (not shown) or the like may be provided for controlling the motion of both the upper and bottom jaw members 236 and 260.

It is pointed out that the cylinders 238, 262 and 264 consist of double action hydraulic cylinders and that they are all actuated by an external power source (not shown).

As seen in FIG. 1, the sheathing apparatus 10 further includes an entry conveyor 350 and an exit conveyor 352. The automaton (not shown) is connected to both conveyors 350 and 352 to control the operation thereof. The rollers of the entry conveyor 350 and the exit conveyor 352 which are respectively disposed near the entry of the stretching unit 11 and next to the exit ends of the stretching unit 11 and of the sealing unit 200 are covered with a material having a high coefficient of friction, such as rubber, to thus ensure that there is no sliding between the bundle to be conveyed and the rollers.

Moreover, the roller 354 of the exit conveyor 352 which is disposed immediately downstream of the stretching unit 11 is vertically displaceable to permit the loading of the tubular sheath S into the stretching unit 11. Accordingly, when it is desired to load the stretching unit 11, the roller 354 must be displaced downwardly. When the loading operation is terminated, the roller 354 is displaced upwardly into a functional position thereof.

It is noted that the number of rollers per conveyor is sufficient to prevent tilting of the bundles which are displaced thereon.

Figure 10:
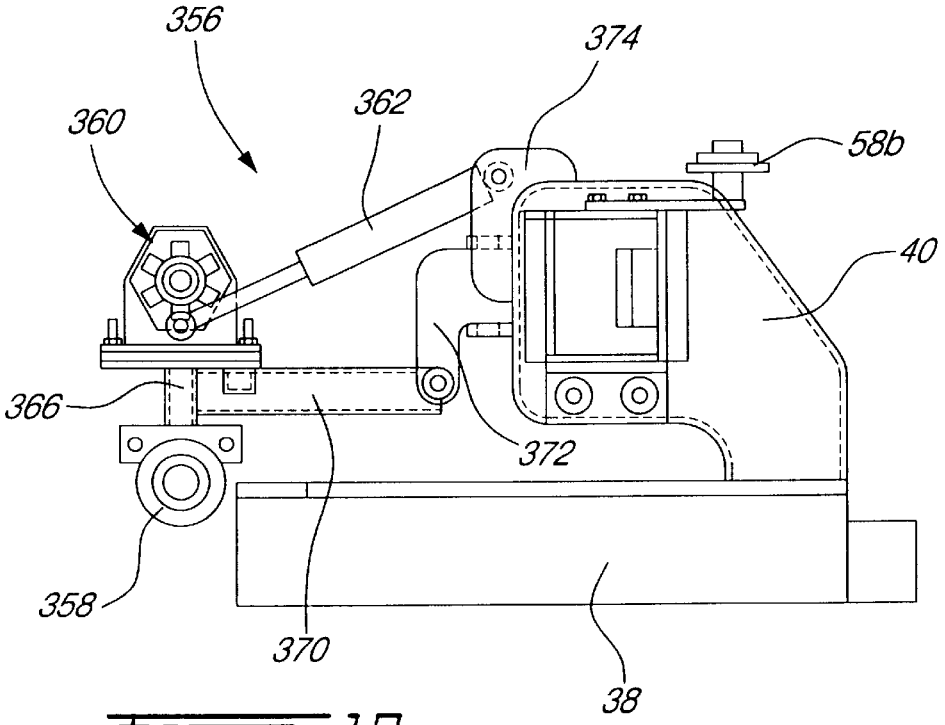
FIG. 10 is a side elevational view of a driving roller assembly mounted to an upper mobile member of the stretching unit in accordance with the present invention.

As seen in FIG. 10, it is also contemplated to install a driving roller assembly 356 on the upper mobile member 20 of the stretching unit 11 to facilitate the deployment of the folded sheath S after the front end of a bundle has engaged the closed downstream end thereof. The driving roller assembly 356 is also operative to assist the advancement of small bundles, i.e. having less than five feet long, through the sheathing apparatus 10. Indeed, experimental tests have proved that the tension in the taut sheath S is such that when a bundle of about five feet long abuts the closed downstream end thereof, the friction between the under surface of the bundle and the entry conveyor 350 is not sufficient to further advance the bundle through the sheathing apparatus 10 and cause the sheath S to unfold from the retaining hook members 32 to 38.

The driving roller assembly 356 generally comprises a main roller 358 rotatably driven by a conventional motor and speed reducer assembly 360, and an hydraulic cylinder 362 adapted to displace the main roller 358 between an idle position where the same is disposed above the retaining hook members 36 and 38 such as to clear the passage for the introduction of a bundle through the stretching unit 11, i.e. into the sheath S, and an operational position where the main roller 358 is lowered against the top surface of a bundle partially introduced in the sheath S.

Figure 11:
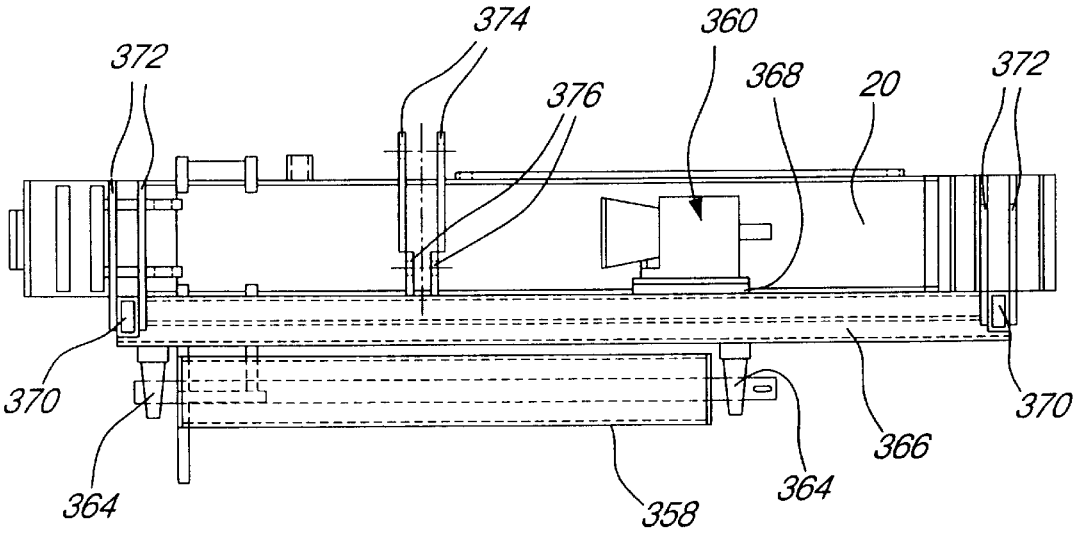
FIG. 11 is a front elevational view of the driving roller assembly of FIG. 10.

The main roller 358 is supported at opposed ends thereof by pillow blocks 364 secured to an undersurface of an elongated member 366 extending in parallel relationship to the upper mobile member 20 of the stretching unit 11. A supporting plate 368 is secured to an upper surface of the elongated member 366 to provide a mounting surface for the motor and speed reducer assembly 360. Two arms 370 extend respectively rearwardly from opposed ends of the elongated member 366. The arms 370 are respectively pivotally mounted at a free end thereof to two pairs of spaced apart L-shaped plates 372 secured to a rear surface of the upper mobile 20, as shown in FIGS. 10 and 11.

The cylinder 362 is mounted at a first end thereof to two spaced apart L-shaped plates 374 welded to top and rear surfaces of the upper mobile member 20 and at a second end thereof to two spaced apart plates 376 extending upwardly from the top surface of the elongated member 366. Accordingly, the cylinder 362 may be retracted or extended to pivot the elongated member 366 about the free ends of the arms 370 so as to raise or lower the main roller 358, respectively.

The main roller 358 is covered with a material having a high coefficient of friction, such as rubber, and has the same dimensions as the rollers of the entry and exit conveyors 350 and 352. Moreover, the speed reduction ratio of the driving roller assembly 356 is the same as the speed reduction ratio of the entry and exit conveyors 350 and 352.

The sheathing apparatus 10 operates generally as follows. Initially, an operator has to insert an elongated loading finger 176 through the receiving opening defined by the tubular folded sheath S and slidably insert one end portion of the elongated loading finger 176 into one of the cylindrical members 190 of the loading arm 100. Thereafter, a second elongated loading finger 176 is inserted through the receiving opening defined by the tubular sheath S and slidably introduced at one end thereof into a second cylindrical member 190 located at the same elevation as the first one. Then, two other elongated loading fingers 176 are installed in position into the cylindrical members 174 in the same way as the two previously mentioned elongated loading fingers 176, whereby the tubular sheath S is supported by the four elongated loading fingers 176 of the loading arm 100 so as to define a square or rectangular receiving opening.

The aforementioned cylinder (not shown) is then extended so as to elevate the third arm portion 120 above the exit conveyor 352 to thus permit the positioning of the loading arm 100 at the downstream end of the stretching unit 11. The cylinder 186 is also extended to displace the upper part 160 of the third arm portion 120 upwardly and thus vertically stretch the tubular sheath S such that the receiving opening defined by the tubular sheath S becomes slightly greater than the one defined by the retaining hook members 32 to 38 of the stretching unit 11.

Accordingly, the first arm portion 112, the second arm portion 114 and the third arm portion 120 of the loading arm 100 are respectively manually pivoted about the shafts 132, 142 and 166 so as to pass the loading arm 100 through the sealing unit 200 and align the receiving opening defined by tubular sheath S with the retaining hook members 32 to 38. It is pointed that the operator may also have to activate the aforementioned cylinder (not shown) to adjust the elevation of the third arm portion 120 relative to that of the retaining hook members 32 to 38 to permit the installation of the sheath S on the retaining hook members 32 to 38. Once, the sheath S has been disposed around the retaining hook members 32 to 38, the cylinder 186 is retracted to allow the sheath S to contract on the retaining hook members 32 to 38. Thereafter, the loading arm 100 is returned to its original position on a side of the exit conveyor 352 downstream of the sealing unit 200.

During the loading operation of the tubular sheath S in the stretching unit 11, all of the cylinders 42 and 44 are contracted such that the upper mobile member 20 and the tubular sliding sleeves 40 are in their innermost position. Therefore, in this position, the opening defined by the frame 12 is reduced to its minimum so as to facilitate the installation of the tubular folded sheath S around the retaining hook members 32, 34, 36 and 38. More particularly, the upper mobile member 20 of the frame 12 is moved downwardly by simultaneous operation of both vertical cylinders 44 so as to displace the retaining hook members 36 and 38 mounted thereon toward the retaining hook members 32 and 34 mounted on the bottom member 14 of the frame 12. Similarly, the retaining hook members 34 and 38 are respectively slidably moved along the bottom member 14 and the upper mobile 20 toward the retaining hook members 32 and 36 by simultaneous operation of the horizontal cylinders 42. The activation of the vertical and horizontal cylinders 42 and 44 is done by the operator via the automaton (not shown).

After the sheath S has been installed in the stretching unit 11 as described hereinbefore, the horizontal and vertical cylinders 42 and 44 are extended so as to impart a preliminary tension in the tubular sheath S. Thereafter, a sufficient portion of the sheath S is pulled off the retaining hook members 32, 34, 36 and 38 for being eventually placed around any means which is adapted to simulate the rear end portion of a bundle of wood downstream from the sealing unit 200. For instance, two C-shaped members (not shown) may be pivotally mounted at each end thereof to the third arm portion 120 of the loading arm 100 to receive thereon the downstream end of the unfolded portion of the sheath S.

Once, a sufficient portion of the sheath S has been pulled off the retaining hook members 32, 34, 36 and 38, the vertical cylinders 44 are again simultaneously extended so as to move the upper mobile member 20 of the frame 12 upwardly and thus vertically stretch the sheath S. Similarly, the horizontal cylinders 42 are simultaneously extended so as to slidably move the square tubular sliding sleeves 40 and thus the retaining hook members 34 and 38 respectively along the bottom member 14 and the upper mobile member 20 of the frame 12. These outward displacements stretch the sheath S to a greater rectangular cross-section than that of the bundle of wood B to be sheathed.

Thereafter, the downstream end of the unfolded portion of the tubular sheath S is manually positioned around the C-shaped members (not shown) which have first been pivoted in front of the third arm portion 120 of the loading arm 100. It is understood that for this particular application the loading arm 100 is disposed downstream from the sealing unit 200.

A first bundle is then brought through the taut receiving opening of the sheath S by the entry conveyor 350. A limit switch (not shown) disposed between the sealing unit 200 and the stretching unit 11 is operational to cause the immobilization of the first bundle as soon as the front or downstream end of the first bundle is detected by this limit switch. Then, the main roller 358 of the driving roller assembly 356 is lowered against an upper surface of the first bundle.

Therefore, at this point, the downstream end portion of the sheath S is disposed around the bundle simulator, i.e. the two C-shaped members, downstream of the sealing unit 200, and the first bundle is immobilized upstream of the sealing unit 200. The sheath S is then sealed upstream of the bundle simulator (not shown) and cut thereat in such a way that the remainder of the sheath S is sealed at its new downstream end.

More specifically, the sealing operation is performed by the sealing unit 200 and generally comprises the steps of first downwardly displacing the upper jaw member 236 to a position which generally corresponds to the center of the bundle to be sheathed and upwardly displacing the bottom jaw member 260 to a position where the top and bottom jaw members 236 and 260 are still in a partially open state such that the sheath S extending therebetween is not yet retained in position by the upper and bottom jaw members 236 and 260. The fingers 324 of both bag folding fingers assemblies 216 and 218 are then displaced towards the center of the sealing unit 200 to pleat the sheath S. Once the fingers 324 have reach their limit of travel, they remain in position and the cylinders 262 and 264 are activated to upwardly displace the bottom jaw member 260 to a position where the jaw members 236 and 260 are closed such as to retain the sheath S in position with the bag holding members 258 and 288 thereof. In this position the springs 294 are submitted to an initial compression. However, in this particular position, the heating bands (not shown) of the upper and bottom jaw members 236 and 260 are still not in contact. Thereafter, the fingers 324 are displaced outwardly relative to the frame 210 to their original position and the heating filament (not shown) is powered to cut the sheath S. Once the sheath has been cut, the bottom jaw member 260 is further upwardly displaced to bring the heating bands of the upper and bottom jaw members 236 and 260 into contact. Accordingly, in this position the springs 294 are further compressed. Then, the heating bands are powered to seal the sheath S on each side of the cut. Once the sheath S has been sealed, the upper and bottom jaw members 236 and 260 remain in a closed position thereof to let the sealed portions of the sheath cool down. Thereafter, the upper and bottom jaw members 236 and 260 are respectively upwardly and downwardly displaced to their respective original positions, thereby releasing the spring 294 supporting the bag holding members 288 of the bottom jaw member 260.

After the sealing operation has been completed, the bundle simulator (not shown) and the portion of the sheath S remaining thereon are removed from the sheathing apparatus 10.

At this stage, a complete bagging cycle can be started and controlled via the automaton (not shown). Accordingly, the first bundle, which is already engaged in the taut receiving opening defined by the sheath S, is then further advanced through the sheathing apparatus 10. As the front or downstream end of the first bundle engages the sealed end of the sheath S, the latter gradually unfolds from the retaining hook members 32, 34, 36 and 38 and contracts around the first bundle.

A limit switch (not shown) disposed at the entry of the stretching unit 11 is operational to detect the rear end of the first bundle and to send a signal to the automaton to raise the main roller 358 of the driving roller assembly 356 after a predetermined period of time so as to clear the passage for the second bundle to be sheathed. The main roller will be lowered into its functional position for the second time when the switch located between the stretching and sealing units 11 and 200 detects the front end of the second bundle.

When the limit switch (not shown) disposed between the stretching and sealing units 11 and 200 detects the rear or upstream end of the first bundle, the same is automatically immobilized. Then, a second bundle is conveyed by the entry conveyor 350. The limit switch provided at the entry of the stretching unit 11 is also operational to detect the downstream or front end of the second bundle. Approximately six seconds after the detection of the front end of the second bundle by the limit switch disposed at the entry of the stretching unit 11, the first bundle starts to advance through the sheathing apparatus 10 at the same speed as the second bundle. The speed of the two bundles must be equal when they are in contact with the tubular sheath S to prevent the same from rupturing. The six second time period generally corresponds to the time required to obtain a distance of about twenty six inches between the two bundles for a given advancement speed. The two bundles are immobilized when the front or downstream end of the second bundle is detected by the limit switch disposed between the stretching and sealing units 11 and 200. Thereafter, the first bundle is moved back until a limit switch (not shown) disposed just after the exit of the sealing unit 200 detects the rear or upstream end of the first bundle. At this stage, the distance between the two bundles is approximately equal to fourteen inches. The backward motion of the first bundle permit to remove the tension in the sheath S at the location where the same will be cut and sealed, i.e. between the two bundles.

The sealing unit 200 then cuts the sheath S and seals the two portions located on both sides of the cut, i.e. the portion of the sheath adjacent to the rear end of the first bundle and the portion adjacent to the front end of the second bundle. Accordingly, the sealed portion located upstream of the cut becomes the closed downstream end of the second bundle to be sheathed. Moreover, as the sealing unit 200 is operational to cut the sheath between the two sealed portions of the sheath, the sheathing bundle, i.e. the first bundle, is detached from the unused sheath, whereby each bundle is individually bagged in a distinct package.

At the exit of the sheathing apparatus 10, the bagged bundle is moved to a storage area by the exit conveyor 352, as seen in FIG. 1. Thereafter, the second bundle may be bagged as per the cycle described hereinbefore.

When the sheath S has been nearly completely unfolded and cannot accommodate a further bundle B, the production is stopped and another folded sheath S is installed in the same manner as described hereinabove.

Figure 12:
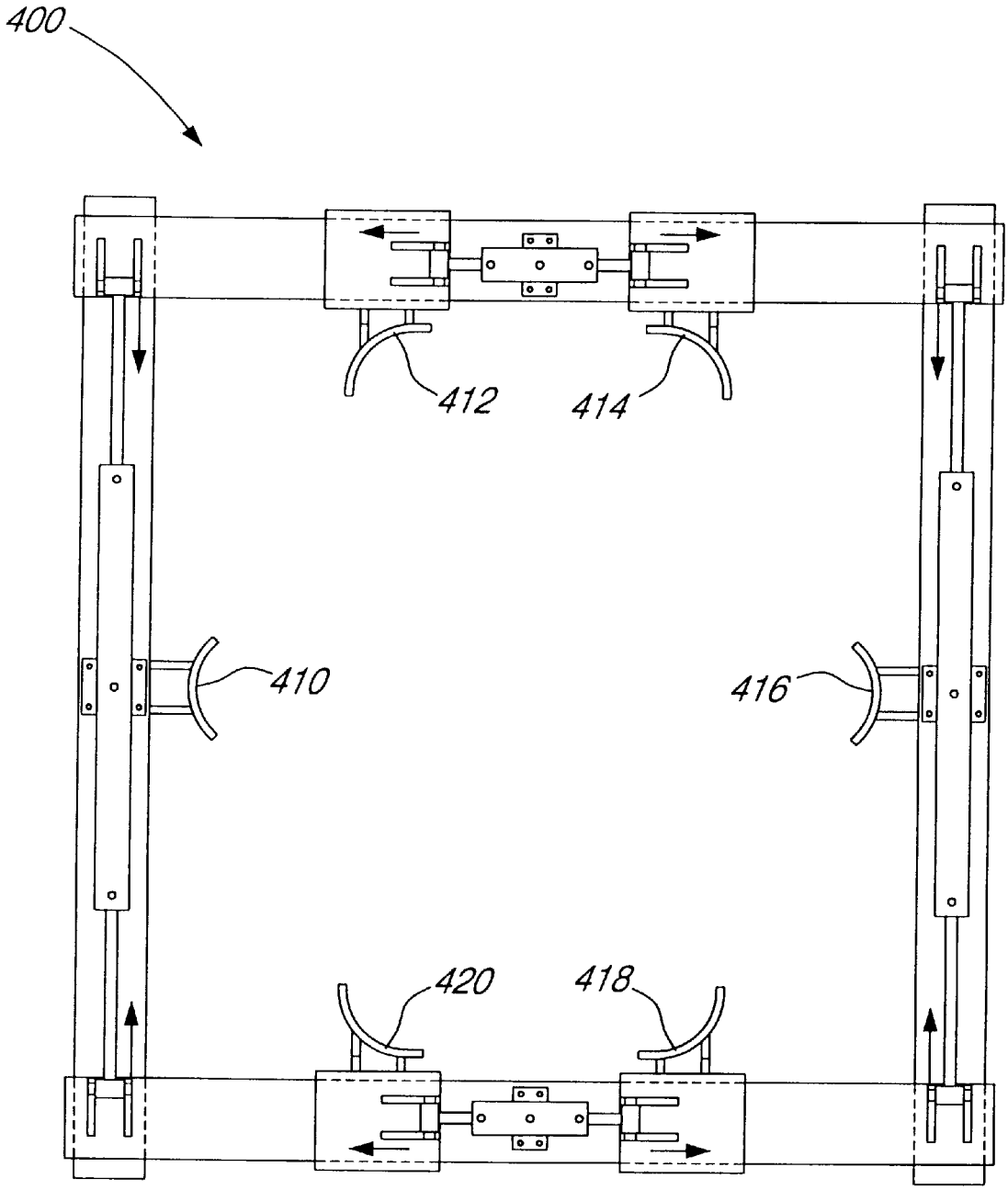
FIG. 12 is a schematic end elevational view of a stretching unit in accordance with a second embodiment of the present invention.

In a second preferred embodiment of the present invention illustrated in FIG. 12, the stretching unit 400 comprises retaining hook members 410, 412, 414, 416, 418 and 420 which are strategically mounted on the frame of the sheathing apparatus for sheathing round loads of material. These hook members 410 to 420 are arcuate in shape, as opposed to the L-shaped members of the embodiment of FIGS. 2 to 5, to ensure a more circular opening within the sheath which can thus better conform to the outside shape of the load to be bagged, or which at least does not require to be stretched as much to obtain the necessary clearance for the load. The hook members 410 to 420 can be displaceable in a variety of directions using cylinders and, in some cases, independently in a way similar to the previous embodiment, and this depends on various design choices which can be made in the construction of the stretching units.

Figure 13:
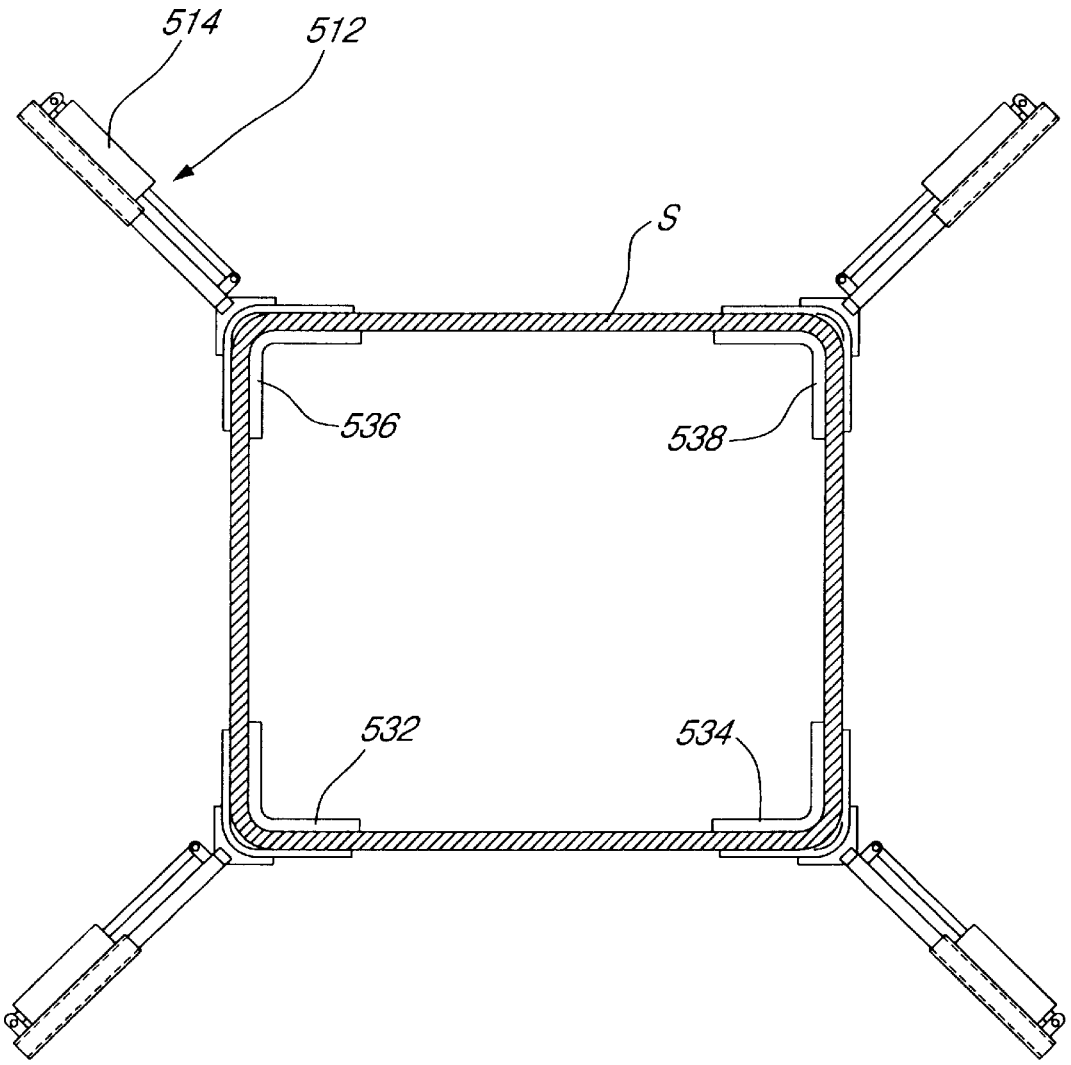
FIG. 13 is a schematic rear end elevational view of a stretching unit in accordance with a third embodiment of the present invention, wherein radial holding arms are provided for holding the sheath when the same is being sealed by the sealing unit.

As shown in FIG. 13, the stretching unit may be provided at each back corner thereof with a holding arm 512 which is capable of outward and inward radial movement relative to the stretching unit. Each holding arm 512 is operated by an individual cylinder 514. The holding arms 512 are operational to hold the tubular sheath S on the retaining hook members 532 to 538 when the sealing unit 200 is operated. However, it is understood that the sheathing apparatus may be manufactured without holding arms 512, as the amount of tension in the sheath S is normally sufficient to retain the same on the retaining hook members 532 to 538.

According to a further embodiment which is not herein illustrated, one of the vertical cylinders 44 of the stretching unit 11, is mounted at a bottom end thereof to the sliding sleeve 40 of the bottom member 14 and at an upper end thereof to the sliding sleeve 40 of the upper mobile member 20.

What is claimed is:

1. A method of wrapping bundles into individuals bags, comprising the steps of installing a folded tubular expandable resilient sheath around a plurality of displaceable bag retaining means, stretching the sheath so as to define a taut upstream receiving opening for allowing insertion of bundles into the sheath, closing a downstream end portion of the sheath, inserting a first bundle through the taut receiving opening and into the sheath, advancing a second bundle through the taut receiving opening and into the sheath, immobilizing the first and second bundles into respective first positions where a rear end of the first bundle is located downstream from a sealing unit and a front end of the second bundle is located upstream from the sealing unit, moving the first bundle backward to a final position where the rear end thereof is downstream from the sealing unit, and activating the sealing unit to cut and close the sheath on each side of the cut.

2. A method as defined in claim 1, comprising after stoppage of said first and second bundles in said first positions, the intermediate steps of advancing the second bundle alone, then said first and second bundles together at a same speed, immobilizing the second bundle at its final position located upstream from the sealing unit, immobilizing the first bundle downstream of the sealing unit, and then moving the first bundle backwards to its said final position where the rear end thereof is still downstream from the sealing unit.

* * * * *